US006801736B2

(12) United States Patent
Senda

(10) Patent No.: US 6,801,736 B2
(45) Date of Patent: Oct. 5, 2004

(54) IMAGE FORMING DEVICE HAVING A PLURALITY OF IMAGE FORMING UNITS WITH A SINGLE DRIVE UNIT

(75) Inventor: Seiichi Senda, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/146,960

(22) Filed: May 17, 2002

(65) Prior Publication Data

US 2002/0172532 A1 Nov. 21, 2002

(30) Foreign Application Priority Data

May 17, 2001 (JP) ..... 2001-147970

(51) Int. Cl.[7] ..... G03G 1/00
(52) U.S. Cl. ..... 399/167

(58) Field of Search ..... 399/167, 313, 399/303, 306

(56) References Cited

U.S. PATENT DOCUMENTS 5,386,286 A * 1/1995 Kinouchi et al. ..... 399/167
5,933,687 A * 8/1999 Okuno et al. ..... 399/167
5,970,286 A * 10/1999 Numazu et al. ..... 399/167

* cited by examiner

*Primary Examiner*—Quana Grainger
(74) *Attorney, Agent, or Firm*—Oliff & Berridge, PLC

(57) ABSTRACT

An image forming includes a plurality of photosensitive bodies and a drive unit. Each photosensitive body forms an image having a different color. The drive unit selectively switches between forward drive and reverse drive. The drive unit uses forward drive to selectively drive a particular one of the plurality of photosensitive bodies and uses reverse drive to selectively drive another one of the plurality of photosensitive bodies.

21 Claims, 4 Drawing Sheets

IMAGE FORMING DEVICE HAVING A PLURALITY OF IMAGE FORMING UNITS WITH A SINGLE DRIVE UNIT

BACKGROUND OF THE INVENTION

1. Field of the Invention

The present invention relates to an image forming device such as a color laser printer.

2. Description of the Related Art

A tandem laser printer is one type of laser printer for forming full-color images. One example of a tandem laser printer includes an image forming unit for each color. Each image forming unit includes a developing roller, a photosensitive drum, a charge unit, and an exposure unit. The developing roller, the charge unit, and the exposure unit are disposed in confrontation with the photosensitive drum. The charge unit forms a uniform charge on the surface of the photosensitive drum. The exposure unit selectively exposes portions of the charged surface to form a latent static-electric image on the surface of the photosensitive drum. The developing roller bears toner on its surface and develops the latent static-electric image using the toner.

The visible toner images developed for each color are transferred one at a time in order onto a transfer belt so that a full-color image can be formed at substantially the same speed as a monochrome image.

Some tandem color laser printers can selectively switch between forming color images and monochrome images. That is, to form a color image, all four photosensitive drums are driven to form images in the four colors of yellow, magenta, cyan, and black. The different color images are transferred one at a time into a stacked condition onto a transfer belt to form a color image. On the other hand, to form a monochrome image, only the photosensitive drum for forming black image is driven so that only a black image is transferred onto the transfer belt to form a monochrome image.

Four motors are provided, one for each photosensitive drum in order to enable selective switching between multi-color and monochrome image formation. All four of the motors are driven when a multi-color image is to be formed and only the motor that corresponds to the black photosensitive drum is driven when a monochrome image is to be formed. However, providing four motors in this manner increases production costs. Also, the control circuit must be able to control drive of all the motors, which increases the complexity of the printer.

SUMMARY Of THE INVENTION

It is conceivable to drive all four photosensitive drums using a single motor in order to reduce production costs and simplify configuration. To achieve this, it is conceivable to provide an electromagnetic clutch between the single motor and the photosensitive drums that can be switched to selectively transmit drive force from the motor to one or all of the four photosensitive drums. Monochrome images can be formed when only one of the photosensitive drum is driven and multi-color images can be formed when all four photosensitive drums are driven. By providing this electromagnetic clutch, there is no need to provide a separate motor for all of the four photosensitive drums.

However, with this conceivable configuration, the electromagnetic clutch itself as well as circuitry for controlling the switching operation of the electromagnetic clutch must be provided, thereby increasing production costs and complexity of the printer. Also, a large torque is required to rotate all four of the photosensitive drums. As a result, a great deal of power would be required to prevent the electromagnetic clutch from slipping while a multi-color image is being formed. This would greatly increase running costs.

It is an objective of the present invention to overcome the above-described problems and to provide an image forming device with low production coats and a simple configuration capable of selectively switching drive of a plurality of photosensitive bodies and selectively forming multi-color and monochrome images.

To achieve the above-described objectives, an image forming device according to one aspect of the present invention includes a plurality of photosensitive bodies and a single drive unit. The plurality of photosensitive bodies each forms an image having a different color. The single drive unit switches between driving at least one of the photosensitive bodies and at least a different one of the photosensitive bodies.

An image forming device according to another aspect of the present invention includes a plurality of developing units, a plurality of photosensitive bodies, a transfer unit, a drive unit, and a transmission mechanism. Each of the developing units is provided for a different one of a plurality of colors. The photosensitive bodies are provided in correspondence with the developing units. The transfer unit is disposed in confrontation with the photosensitive bodies. The drive unit generates drive force. The transmission mechanism switches transmission of the drive force from the drive unit to photosensitive bodies selected in accordance with drive condition of the drive unit.

According to still another aspect of the present invention, an image forming device includes a plurality of developing units, a plurality of photosensitive bodies, a transfer unit, a drive unit, and a transmission mechanism. Each developing unit is provided for a different one of a plurality of colors. The photosensitive bodies are provided in correspondence with the developing units. The transfer unit is disposed in confrontation with the photosensitive bodies. The drive unit switchingly generates forward drive force and reverse drive force. The transmission mechanism transmits drive force from the drive unit to the photosensitive bodies. The transmission mechanism transmits the same direction of drive force to the photosensitive bodies regardless of whether the drive unit generates forward drive force or reverse drive force.

BRIEF DESCRIPTION OF THE DRAWINGS

The above and other objects, features and advantages of the invention will become more apparent from reading the following description of the embodiment taken in connection with the accompanying drawings in which:

FIG. 4(*b*) is a cross-sectional view showing condition of the first one-way clutch mechanism during reverse direction drive of the drive shaft;

FIG. 5(*b*) is a cross-sectional view showing condition of the second one-way clutch mechanism during reverse direction drive of the drive shaft.

DETAILED DESCRIPTION OF THE EMBODIMENTS

Figure 1:
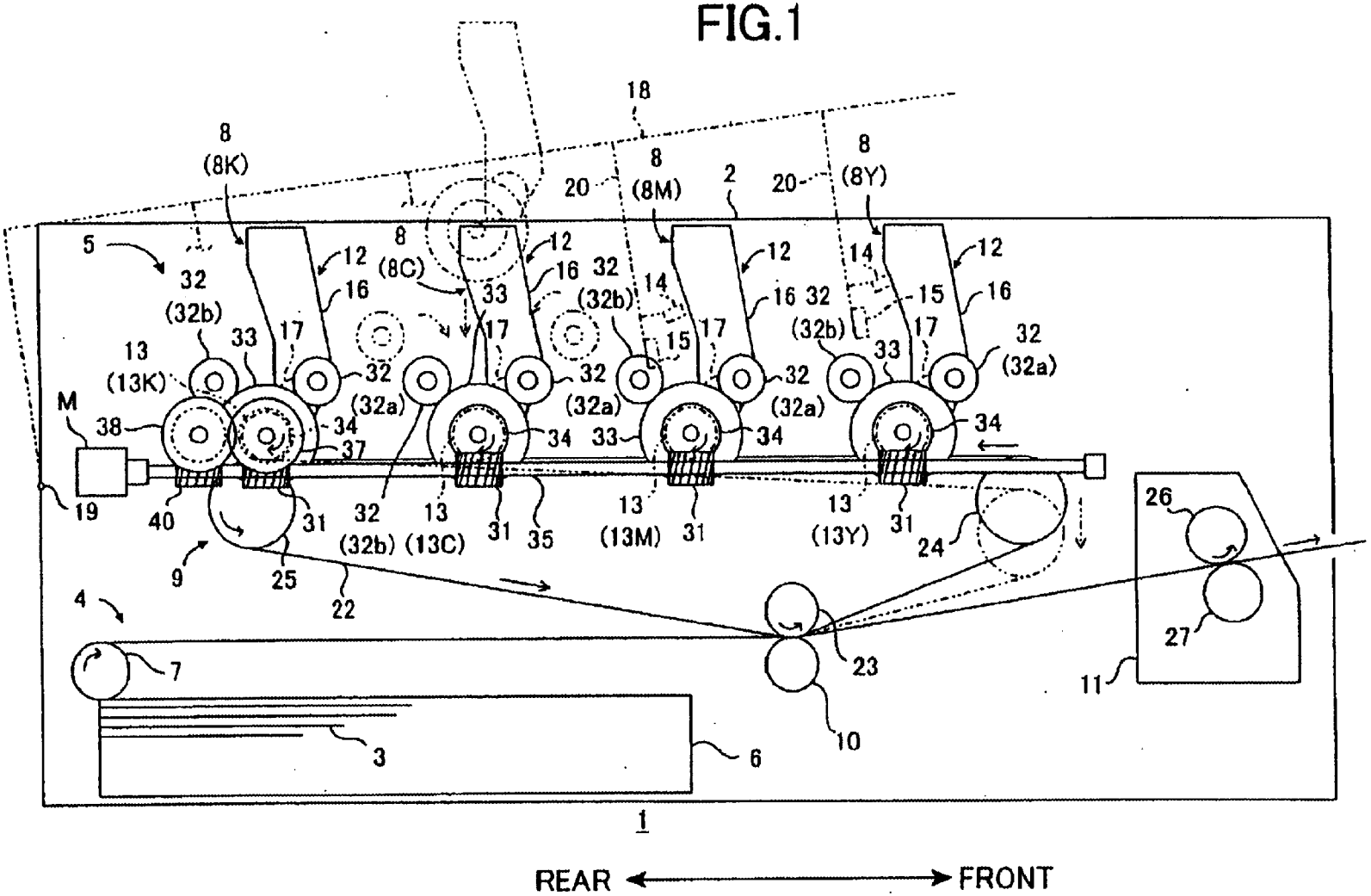
FIG. 1 is a cross-sectional view showing essential components of a color laser printer according to an embodiment of the present invention.

Next, a color laser printer 1 according to an embodiment of the present invention will be described while referring to the attached drawings. As shown in FIG. 1, the laser printer 1 includes a casing 2, an upper cover 18, a sheet-feed portion 4, and an image forming portion 5. The casing 2 houses the sheet-feed portion 4 and the image forming portion 5. The sheet-feed portion 4 is for feeding out sheets 3 one sheet at a time. The image forming portion 5 is for forming images on the fed out sheets 3.

The sheet-feed portion 4 includes a sheet-feed tray 6 and a sheet-feed roller 7. The sheet-feed tray 6 is stacked with sheets 3. The sheet-feed roller 7 feeds out the highest sheet 3 on the sheet-feed tray 6 in order to supply one sheet at a time to the image forming portion 5.

The image forming portion 5 includes four process portions 8K, 8C, 8M, and 8Y, an intermediate transfer mechanism 9, a secondary transfer roller 10, and a fixing portion 11. The four process portions are located in the upper portion of the casing 2 and will be referred to collectively as the "process portions 8" to simplify explanation.

The four process portions a include a yellow developing process portion 8Y, a magenta developing process portion 8M, a cyan developing process portion 8C, and a black developing process portion 8K. The four process portions 8 are aligned in the horizontal direction, separated by a predetermined spacing. Each developing process portion 8 has substantially the same configuration and surrounding components, so the configuration of the cyan developing process portion 8C and surrounding components will be described as a representative example.

Figure 2:
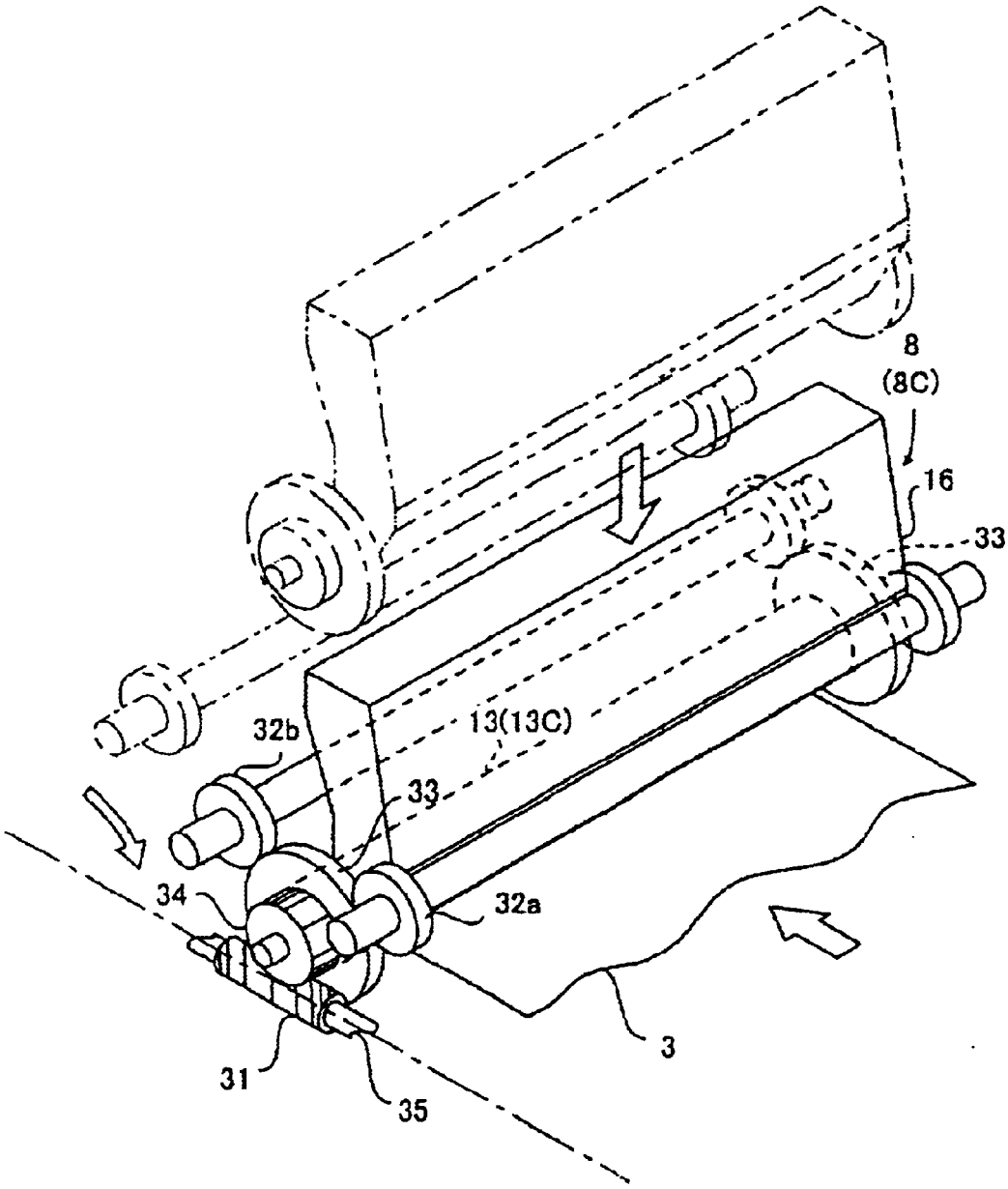
FIG. 2 is a perspective view showing a cyan developing process portion as an example of developing process portions in the color laser printer of FIG. 1.

As shown in FIG. 2, the cyan developing process portion 8C includes a process cartridge 12, an LED array 14, and a scorotron charge unit 15. The process cartridge 12 is freely detachably mounted to the casing 2 as indicated by two-dot chain line in FIGS. 1 and 2. As shown in FIG. 2, the process cartridge 12 includes a photosensitive drum 13 and a developing cartridge 16. The developing cartridge 16 is mounted on the photosensitive drum 13. The developing cartridge 16 includes a developing roller 17 and, although not shown in the drawings, a layer-thickness regulating blade, a toner-supply roller, and a toner box.

The toner box of the developing cartridge 16 is filled with non-magnetic, single-component toner that charges to a positive charge. Because the cyan developing process portion 8C is being described in this example, the toner box in the developing cartridge 16 is filled with cyan-colored toner. However, the toner box in the developing cartridge 16 of the yellow developing process portion 8Y is filled with yellow-colored toner, the toner box in the developing cartridge 16 of the magenta developing process portion 8M is filled with magenta-colored toner, and the toner box in the developing cartridge 16 of the black developing process portion 8Y is filled with black-colored toner.

The toner-supply roller is rotatably disposed below the toner box. The toner-supply roller includes a metal roller shaft that is covered by a conductive foam roller. The developing roller 17 is rotatably disposed below the toner-supply roller in pressing contact with the toner-supply roller. The developing roller 17 includes a metal roller shaft that is covered by a conductive rubber roller.

The layer-thickness regulating blade is disposed adjacent to the developing roller 17. The layer-thickness regulating blade includes a blade body and a pressing portion. The blade body is made from a metal plate spring and is supported at one end by the developing cartridge 16 at a position near the developing roller 17. The pressing portion is provided on the free end of the blade body, that is, at the end opposite from the end supported by the developing cartridge 16. The pressing portion is made from silicon rubber that has electrically insulating properties and is formed in a half-circle shape when viewed in cross-section. Resilient force of the blade body presses the pressing portion onto the developing roller 17.

Rotation of the toner-supply roller supplies the toner from the toner box to the developing roller 17, where friction between the toner-supply roller and the developing roller 17 charges the toner to a positive charge. As the developing roller 17 rotates, the layer-thickness regulating blade operates to regulate the toner on the developing roller 17 to a fixed thickness and to sufficiently charge the toner.

The photosensitive drum 13 is attached to the developing cartridge 16 in a condition below and in confrontation with the developing roller 17. The photosensitive drum 13 is driven to rotate clockwise as indicated by arrows in FIG. 1. The photosensitive drum 13 includes a cylindrical drum body that is connected to ground. The outer circumferential surface of the photosensitive drum 13 is made from an organic photosensitive material including polycarbonate.

The upper cover 18 covers the upper portion of the casing 2. The upper cover 18 is pivotably attached to a side wall of the casing 2 by a hinge 19. A downward-extending attachment frame 20 for each process cartridge 12 is provided integrally with the upper cover 18. The LED array 14 and the scorotron charge unit 15 are attached to the attachment frame 20 so that by opening the upper cover 18 the process cartridge 12 can be attached and removed as indicated in two-dot chain line in FIGS. 1 and 2.

The LED array 14 is configured from a plurality of LEDs aligned in a row disposed above the photosensitive drum 13 when the upper cover 18 is closed. The LEDs selectively emit light based on image data to selectively irradiate the surface of the photosensitive drum 13.

The scorotron charge unit 15 is disposed, that is, when the upper cover 18 is closed, to the side of the photosensitive drum 13 at a position separated from the photosensitive drum 13 so as not to contact the photosensitive drum 13. The scorotron charge unit 15 is a positively-charging scorotron type charge unit that generates a corona discharge from a charge wire made from tungsten, for example. The scorotron charge unit 15 charges the surface of the photosensitive drum 13 to a uniform positive charge.

After the scorotron charge unit 15 charges the surface of the photosensitive drum 13 to a uniform positive charge, the LED array 14 emits light based on image data to selectively expose the charged surface of the photosensitive drum 13. The electric potential of the uniform charge on the surface of the photosensitive drum 13 drops where exposed by light from the LED array 14. The portions at the surface with electric potential lowered in this manner form a latent static-electric image.

As mentioned previously, the toner borne on the surface of the developing roller 17 is charged to a positive charge.

When the toner on the surface of the developing roller 17 moves into confrontation with the surface of the photosensitive drum 13, the toner is selectively borne on the latent static-electric image, thereby developing the latent static-electric image into a visible toner image. This visible toner forming process is performed separately for each different color the process portions 8K, 8C, 8M, and 8Y. Accordingly, inverse development is achieved for each color. The visible image borne on the photosensitive dram 13 is transferred onto the endless belt 22 as the corresponding portion of the endless belt 22 moves into and out of confrontation with the photosensitive drum 13 by circulating movement of the endless belt 22.

As shown in FIG. 1, the intermediate transfer mechanism 9 is disposed in confrontation with all of the photosensitive drums 13 from a position below the photosensitive drums 13. The intermediate transfer mechanism 9 includes the endless belt 22 and three rollers, that is, a first roller 23, a second roller 24, and a third roller 25. The first roller 23 is provided downstream from the sheet-feed roller 7 with respect to the transport direction of sheets 3. The second roller 24 is disposed above the first roller 23 at a position upstream from the yellow developing process unit 8Y with respect to the movement direction of the endless belt 22. The third roller 25 is disposed substantially beneath the black developing process unit 8K separated from the second roller 24 by a predetermined distance in the horizontal direction. The first through third rollers 23 to 25 are disposed at the corners of an imaginary inverted triangle. The upper edge of the imaginary triangle is formed by an imaginary horizontal line that connects the upper edges or the second roller 24 and the third roller 25 and contacts the lower edge of between the photosensitive drums 13. Another edge of the imaginary triangle extends diagonally downward and frontward from the third roller 25 to the first roller 23 and still another extends diagonally upward and forward the first roller 23 to the second roller 24.

The endless belt 22 is wound around the outer periphery of the first through third rollers 23 to 25. The endless belt 22 moves between the second and third rollers 24, 25 in a direction indicated by arrows in FIG. 1, pressed against the lower edge of the photosensitive drums 13 by a predetermined pressing force. It should be noted that the endless belt 22 is made from conductive resin, such as polycarbonate or polyimide, dispersed with conductive particles, such as carbon.

Rotation of the first through third rollers 23 to 25 brings the endless belt 22 sequentially into confrontation with the photosensitive drums 13 so that visible toner images formed in different colors by the different photosensitive drums 13 are transferred onto the endless belt 22 one at a time in order, and overlap to form a full-color image. For example, first a yellow visible image, which was formed on the corresponding photosensitive drum 13 from yellow toner that fills the developing cartridge 16 of the yellow process portion 8Y, is transferred onto the endless belt 22, then a magenta visible image, which was formed on the magenta photosensitive drum 13M from magenta toner that fills the developing cartridge 16 of the magenta process portion 8M, is transferred onto the endless belt 22 on top of the previously transferred yellow image. By the same operation, the cyan visible image, which was formed on the cyan photosensitive drum 13C from cyan toner that fills the developing cartridge 16 of the cyan process portion 8C, and the black visible image, which was formed on the black photosensitive drum 13B from black toner that fills the developing cartridge 16 of the black process portion 8B, are also transferred onto the endless belt 22 in an overlapping condition with the yellow visible image and the magenta visible image so that a color image is formed on the endless belt 22.

The secondary transfer roller 10 is rotatably disposed at a position in confrontation with the first roller 23 of the intermediate transfer mechanism 9 through a sheet 3. The secondary roller 10 includes a metal roller shaft and a conductive rubber roller. The roller covers the metal roller shaft. The secondary roller 10 is applied with a predetermined transfer bias. The color image formed on the endless belt 22 is transferred all at once onto the sheet 3 passing between the endless belt 22 and the secondary transfer roller 10.

In this way, the visible toner images borne on the different photosensitive drums 13 are temporarily transferred onto the endless belt 22 of the intermediate transfer mechanism 9. After a color image is formed on the endless belt 22 by stacking the different colored images onto the endless belt 22, the full color image is transferred in a single action from the endless belt 22 onto the secondary transfer roller 10.

The fixing portion 11 is disposed downstream from the secondary transfer roller 10 with respect to the transport direction of the sheet 3. The fixing portion 11 includes a thermal roller 26 and a pressing roller 27. The pressing roller 27 presses against the thermal roller 26. The thermal roller 26 is made from metal and includes a halogen lamp for heating the metal. The thermal roller 26 thermally fixes the color image that was transferred by the secondary transfer roller 10 onto the sheet 3 as the sheet 3 passes between the thermal roller 26 and the pressing roller 27. Afterward, the sheet 3 is discharged from the casing 2.

In this way, the color laser printer 1 includes a photosensitive drum 13 for each color so that using a tandem type mechanism, a full color image can be formed with substantially the same speed as a monochrome image.

The color laser printer 1 includes a first worm gear 31, and two support rollers 32*a*, 32*b* for each photosensitive drum 13. The two support rollers 32*a*, 32*b* will be alternately referred to collectively as support rollers 32 hereinafter. Each set of first worm gear 31 and the support rollers 32 supports the corresponding photosensitive drum 13 in a rotatable manner.

Two drive shafts 25 extend in the direction followed the upper portion of the endless belt 22. Although only one is shown in the drawings, one of the drive shafts 25 is provided on either axial side of the photosensitive drums 13. The drive shafts 25 serve as a common drive source for all of the photosensitive drums 13. The first worm gears 31 are provided on the drive shafts 25 at positions in confrontation with the corresponding photosensitive drums 13.

Two disk-shaped bearing members 33 and two first worm wheels 34 are provided on the outer peripheral surface of each photosensitive drum 13. One of the disk-shaped bearing members 33 and one of the first worm wheels 34 are provided at each axial end of the photosensitive drum 13. As shown in FIG. 2, the first worm wheels 34 are disposed nearer the axial ends of the photosensitive drum 13 than the disk-shaped bearing members 33. Each first worm wheel 34 is meshingly engaged with the corresponding first worm gear 31.

A single reversible motor M is provided for driving rotation of the drive shaft 35 that is visible in FIG. 1. The motor M is a reversible motor and so can selectively rotate the drive shaft 35 in forward or reverse directions.

A pair of support rollers 32 is provided for each photosensitive drum 13. As shown in FIG. 2, the first support roller 32*a* and the second support roller 32*b* are located at the upper portion of each bearing member 33 separated from each other by a predetermined distance. Although not shown detail in the drawings, each set of first and second support rollers 32*a*, 321*b* is provided on the attachment frame 20 of the upper cover 18 so as to swing away from and toward the corresponding photosensitive drum 13 with opening and closing movement of the upper cover 18. When one of the process cartridges 12 is to be removed from the casing 2, the upper cover 18 is opened up to swing the corresponding set of first and second support rollers 32*a*, 32*b* away from the corresponding photosensitive drum 13. On the other hand, after one of the process cartridges 12 is newly mounted into the casing 2, the upper cover 18 is closed up to swing the corresponding set of first and second support rollers 32*a*, 32*b* into pressing contact with the bearing members 33 at both axial ends of the corresponding photosensitive drum 13, while separated from each other by the predetermined distance.

Each axial end photosensitive drum 13 is supported at a total of three positions, that is, by the corresponding first worm gear 31 and two support rollers 32. One of the first worm gears 31 supports an axial end of the corresponding photosensitive drum 13 from below through the corresponding first worm wheel 34. Each pair of support rollers 32 are swingable, via the cover 18, into pressing contact with an axial end of the corresponding photosensitive drum 13 to support the photosensitive drum 13 from above.

With this configuration, each photosensitive drum 13 is supported at three positions, by two support rollers 32 and the drive shaft 35, at both axial ends on its outer peripheral surface, which is formed with extremely high precision. Therefore, the photosensitive drums 13 can be rotated precisely without any eccentricity of rotation. Visible images formed on the photosensitive drums 13 can be transferred at the same speed onto the endless belt 22. Eccentric rotation of the photosensitive drum 13 can be reliably and easily prevented and good images can be formed.

Power from the single motor M is transmitted to drive the drive shaft 35 to rotate. The first worm gears 31 provided on the drive shaft 35 rotate as a result. Therefore, the photosensitive drums 13 are driven to rotate by their first worm wheels 31, which are in meshing engagement with the worm gears 31. Therefore, the photosensitive drums 13 can be reliably rotated using a simple configuration.

All of the photosensitive drums 13 can be driven to rotate by driving the drive shaft 35 to rotate using the single motor M. There is no need to provide a gear train transmission system or a motor for each photosensitive drum 13. Therefore the photosensitive drums 13 can be reliably driven with a simple configuration.

Further, by switching between forward drive and reverse drive of the drive shaft 35 using the motor M, either all or only one of the photosensitive drums 13 can be selectively driven. In order to form a multi-color image, all four photosensitive drums 13, that is, the yellow photosensitive drum 13Y, the magenta photosensitive drum 13M, the cyan photosensitive drum 13C, and the black photosensitive drum 13K, are driven to rotate by forward drive of the drive shaft 35. On the other hand, in order to form a monochrome image, only one of the photosensitive drums 13, that is, the black photosensitive drum 13K, is driven to rotate by reverse drive of the drive shaft 35.

Figure 3:
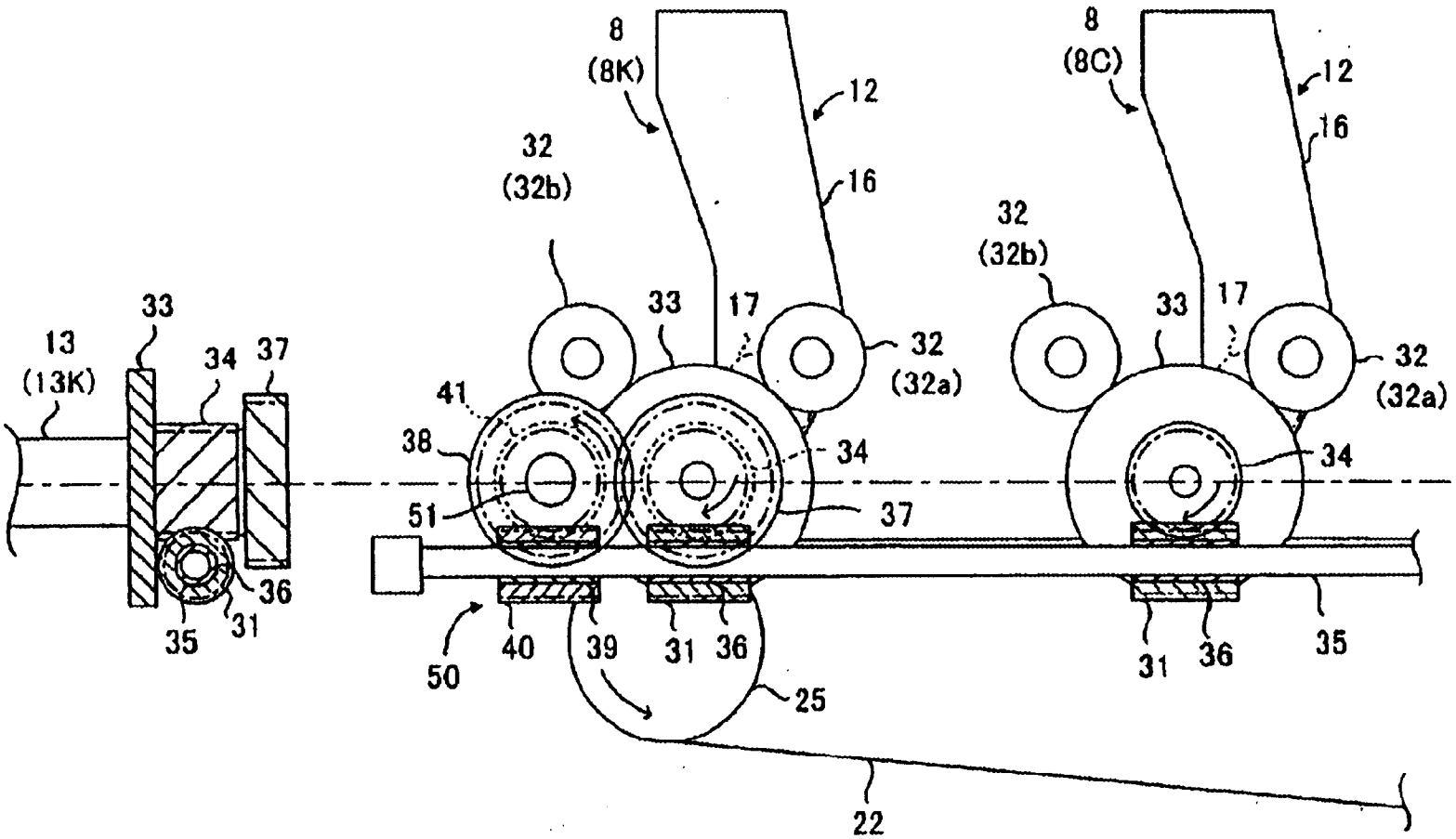
FIG. 3 is a frontal cross-sectional view showing configuration of the color laser printer of FIG. 1 for transmitting drive force and a side view showing details of a reverse direction transmission mechanism.
Figure 4A:
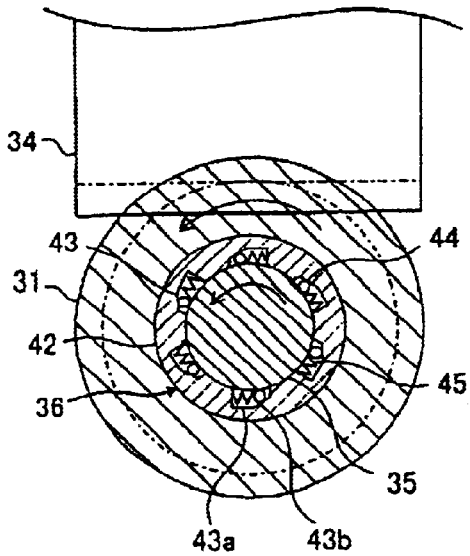
FIG. 4(*a*) is a cross-sectional view showing condition of a first one-way clutch mechanism during forward direction drive of a drive shaft.
Figure 4B:
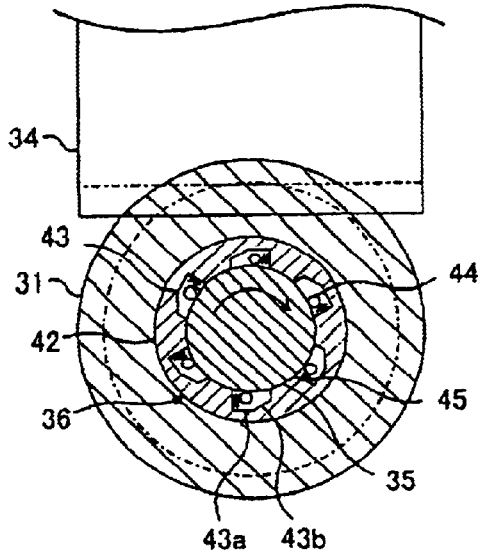

Configuration for achieving this selective rotational drive will be described next. As shown in FIGS. 3, 4(*a*), and 4(*b*), a first one-way clutch mechanism 36 is interposed between the drive shaft 35 and each of the first worm gears 31. As a result, four first one-way clutch mechanisms 36 are provided in total along the drive transmission path between the drive shaft 35 and the four photosensitive drums 13. The first one-way clutch mechanisms 36 transmit drive force only during forward drive of the drive shaft 35. In addition, a reverse direction transmission mechanism 50 is provided along the drive transmission path between the drive shaft 35 that is visible in FIG. 1 and the black photosensitive drum 13K. The reverse direction transmission mechanism 50 transmits drive force from the drive shaft 35 only during reverse drive of the drive shaft 35. With this configuration, three of the photosensitive drums 13, that is, the yellow photosensitive drum 13Y, the magenta photosensitive drum 13M, and the cyan photosensitive drum 13C are only driven during forward drive of the drive shaft 35, and one of the photosensitive drums 13, that is, the black photosensitive drum 13K, is driven both during forward and reverse drive of the drive shaft 35.

The first one-way clutch mechanisms 36 are provided at the outer periphery of the drive shaft 35, within the first worm wheels 31 of each of the four photosensitive drums 13. As shown in FIGS. 4(*a*) and 4(*b*), each first one-way clutch mechanism 36 includes a first sleeve 42, first rollers 44, and springs 45. Each first sleeve 42 is provided so that its inner peripheral surface is slidable with respect to the drive shaft 35 and so that it outer peripheral surface moves integrally with the inner peripheral surface of the corresponding worm gear 31. Said differently, each first sleeve 42 is provided incapable of relative movement with respect to the corresponding worm gear 31. Each first sleeve 42 is formed with a plurality of first grooves 43. One of the first rollers 44 and one of the springs 45 is disposed in each of the first grooves 43.

Each first sleeve 42 has a tube shape that follows the axial direction of the corresponding worm gear 31.

Six first grooves 43 are formed in the outer peripheral surface of each first sleeve 42, spaced at a predetermined interval following around the circumference of the first sleeve 43. The first grooves 43 are formed as openings in the inner peripheral surface of each first sleeve 42 and follow the axial direction of the corresponding first worm gear 31. Although each first groove 43 is substantially rectangular in cross section as can be viewed in FIGS. 4(*a*) and 4(*b*), each first groove 43 includes a broad space 43*a* and a narrow space 43*b*. Each broad space 43*a* is located at the upstream side of the corresponding groove 43 with respect to the forward drive direction of the drive shaft 35, that is, the counterclockwise direction as indicated by an arrow in FIG. 4(*a*), and is formed sufficiently large to enable the corresponding first roller 44 to move freely between the first sleeve 42 and the outer peripheral surface of the drive shaft 35. On the other hand, each narrow space 43*b* is located at the downstream side of the corresponding groove 43 with respect to the forward drive direction of the drive shaft 35, and is formed sufficiently small to firmly sandwich the corresponding first roller 44 between the first sleeve 42 and the outer peripheral surface of the drive shaft 35.

That is, the broad space 43*a* of each first groove 43 is formed into the first sleeve 42 to an average depth from the inner peripheral surface of the first sleeve 42 that is larger than the diameter of the first roller 44. The narrow space 43*b* of each first groove 43 tapers so that its depth from the inner peripheral surface of the first sleeve 42 gradually diminishes from its rear upstream side, where it connects to the corresponding broad space 43*a*, to its front upstream side, where it is shallower than the diameter of the corresponding first roller 44.

Each first roller 44 has a rod shape and is disposed in the corresponding first groove 43 so as to extend following the axial direction of the corresponding first worm gear 31. Each first spring 45 is positioned in the rear end upstream side of the broad space 43*a* of the corresponding first groove 43. The springs 45 constantly urge the corresponding first roller 44 toward the front end downstream side of the corresponding narrow space 43*b*.

Next, operation of the first one-way clutch mechanisms 36 will be described. During forward drive of the drive shaft 35 as shown in FIG. 4(*a*), the urging force of the first springs 45 move the first rollers 44 toward the narrow spaces 43*b* in association with the forward rotation of the drive shaft 35 so that the first rollers 44 become firmly sandwiched between the first sleeve 42 and drive shaft 35 and restrict relative movement between the first sleeve 42 and the drive shaft 35. As a result, forward drive of the drive shaft 35 is transmitted through the first one-way clutch mechanisms 36 to the first worm gears 31 so that the first worm gears 31 rotate with the drive shaft 35.

On the other hand, during reverse drive of the drive shaft 35, that is, when the drive shaft 35 is driven by the motor M to rotate in the clockwise direction indicated by arrows in FIG. 4(*b*), rotation of the drive shaft 35 moves the first rollers 44 against the urging force of the first springs 45 into the broad spaces 43*a* so that the first rollers 44 move freely between the first sleeve 42 and drive shaft 35. Thus, relative movement between the first sleeve 42 and the drive shaft 35 is allowed and reverse drive from the drive shaft 35 is not transmitted through the first one-way clutch mechanisms 36 to the first worm gears 31. The drive shaft 35 rotates idly with respect to the first worm gears 31.

The reverse direction transmission mechanism 50 is disposed along the power transmission path between the drive shaft 35 and the black photosensitive drum 13K. As shown in FIG. 3, the reverse direction transmission mechanism 50 includes a rotation shaft 51, a second worm gear 40, a second worm wheel 41, a first gear 37, and a second gear 38.

The second worm gear 40 is provided around the periphery of the drive shaft 35 at an axial end of the drive shaft 35, further to the axial end than the first worm gear 31 that is in meshing engagement with the first worm wheel 34 of the black photosensitive drum 13K.

The rotation shaft 51 is rotatably supported on the casing 2 at a position that is above and in confrontation with the second worm gear 40. The second worm wheel 41 and the second gear 38 are formed integrally with the axial end of the rotation shaft 51. The second worm wheel 41 is formed further from the axial end of the rotation shaft 51 than is the second gear 38 at a position in confrontation with and in meshing engagement with the second worm gear 40. The second worm wheel 41 has substantially the same outer diameter as the first worm wheel 34.

The second gear 38 is disposed in meshing engagement with the first gear 37 at a position outside from the second worm wheel 41 in the axial direction of the rotation shaft 51.

The first gear 37 is formed at the outer peripheral surface of the black photosensitive drum 13K to have substantially the same outer diameter as the second gear 38. The first gear 37 is disposed on the axial end of the black photosensitive drum 13K at a position further outside than the first worm wheel 34 in the axial direction of the black photosensitive drum 13K. The first gear 37 is in meshing engagement with the second gear 38.

Figure 5A:
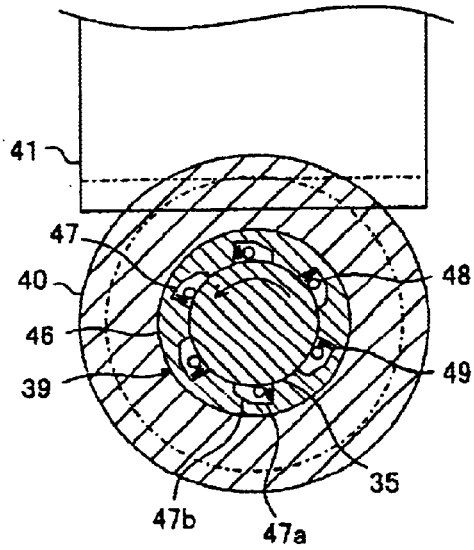
FIG. 5(*a*) is a cross-sectional view shoving condition of a second one-way clutch mechanism during forward direction drive of a drive shaft.
Figure 5B:
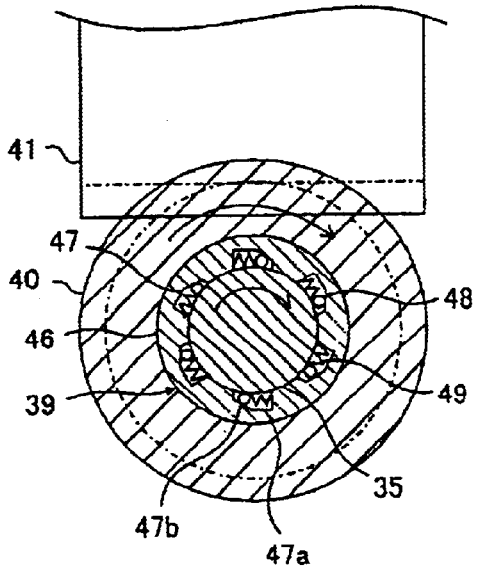

The reverse direction transmission mechanism 50 further includes a second one way clutch mechanism 39 disposed in the second worm gear 40. As shown in FIGS. 5(*a*) and 5(*b*), the second one way clutch mechanism 39 has a configuration similar to the first one way clutch mechanisms 36 and includes a second sleeve 46, second rollers 48, and springs 49. The second sleeve 46 is provided capable of sliding over the outer peripheral surface of the drive shaft 35. Second grooves 47 are formed in the inner peripheral surface of the second sleeve 46. A set of one second roller 48 and one spring 49 is disposed in each of the second grooves 47.

Each second groove 47 includes a broad space 47*a* and a narrow space 47*b*. However, compared with the broad space 43*a* and the narrow space 43*b* of each first groove 43, the broad space 47*a* and the narrow space 47*b* of each second groove 47 have the opposite orientation with respect to the rotational direction of the drive shaft 35. That is, each broad space 47*a* is located at the downstream side of the corresponding groove 47 with respect to the forward drive direction, that is, the counterclockwise direction as indicated by an arrow in FIG. 5(*a*), and each narrow space 47*b* is located at the upstream side of the corresponding groove 47 with respect to the forward drive direction.

Next, operation of the second one-way clutch mechanism 39 will be described. During forward drive of the drive shaft 35 as shown in FIG. 5(*a*), rotation of the drive shaft 35 moves the second rollers 48 against the urging force of the second springs 49 into the broad spaces 47*a*, so that the second rollers 48 move freely between the second sleeve 46 and the drive shaft 35 and relative movement between the second sleeve 46 and the drive shaft 35 is allowed. As a result, forward drive from the drive shaft 35 is not transmitted through the second one-way clutch 39 to the second worm gear 40. The drive shaft 35 therefore rotates idly with respect to the second worm gear 40.

On the other hand, during reverse drive of the drive shaft 35 as shown in FIG. 5(*b*), the reverse Notation of the drive shaft 35 and the urging force of the second springs 49 move the second rollers 48 toward the narrow spaces 47*b*, so that the second rollers 48 become firmly sandwiched between the second sleeve 46 and the drive shaft 35 and restrict relative movement between the first sleeve 42 and the drive shaft 35. As a result, reverse drive of the drive shaft 35 is transmitted through the second one-way clutch 39 to the second worm gear 40 so that the second worm gear 40 rotates with the drive shaft 35.

When the reversible motor M drives the drive shaft 35 in the forward direction, the first one way clutch mechanisms 36 corresponding to all four photosensitive drums 13, that is, to the yellow photosensitive drum 13Y, the magenta photosensitive drum 13M, the cyan photosensitive drum 13*c*, and the black photosensitive drum 13K, transmit the drive force to the first worm gears 31. Therefore, the first worm gears 31 rotate with the rotation of the drive shaft 35, so that the sour photosensitive drums 13, that is, the yellow photosensitive drum 13Y, the magenta photosensitive drum 13M, the cyan photosensitive drum 13C, and the black photosensitive drum 13K, all rotate.

However, during forward drive of the drive shaft 35, the second one way clutch mechanism 39 of the reverse direction transmission mechanism 50 does not transmit drive force to the second worm gear 40. Therefore, the drive shaft 35 rotates idly with respect to the second worm gear 40. It should be noted that at this time, the first gear 37 is driven to rotate in association with rotational drive of the black photosensitive drum 13K and, consequently, the second worm wheel 40 is driven to rotate in the opposite direction from the forward drive direction of the drive shaft 35 through the second gear 38 and the second worm wheel 41. However, even though the second worm wheel 40 is driven to rotate in the opposite direction from the forward drive direction of the drive shaft 35, the second one way clutch mechanism 39 prevents the drive force from being transmitted to the drive shaft 35, so the drive shaft 35 rotates smoothly in the forward direction.

Accordingly, by driving the motor M to drive in the forward direction so that the drive shaft 35 rotates in the forward direction, all of the photosensitive drums 13, that is, the yellow photosensitive drum 13Y, the magenta photosensitive drum 13M, the cyan photosensitive drum 13C, and the black photosensitive drum 13K, can be driven to smoothly rotate and a good-quality color image can be formed.

One the other hand, by driving the motor M to drive in the reverse direction so that the drive shaft 35 rotates in the reverse direction, the second one way clutch mechanism 39 of the reverse direction transmission mechanism 50, which is provided only to a single photosensitive drum 13, that is, the black photosensitive drum 13K, transmits the drive force to the second worm gear 40. Therefore, because the second worm gear 40 rotates with the drive shaft 35, the second worm wheel 41 in meshing engagement with the second worm gear 40 is driven so that, consequently, the black photosensitive drum 13K is driven to rotate through the second gear 38 and the first gear 37. It should be noted that even when the drive shaft 35 rotates in reverse, the black photosensitive drum 13K is driven through the reverse direction transmission mechanism 50 to rotate in the same rotational direction as during forward drive of the drive shaft 35, so that image formation can be smoothly achieved.

Also, during reverse drive of the drive shaft 35, the first one way clutch mechanisms 36 do not transmit drive force to the first worm gears 31. Therefore, the drive shaft 35 will merely rotate idly with respect to the first worm gear 31. For this reason, the other three photosensitive drums 13, that is, the yellow photosensitive drum 13Y, the magenta photosensitive drum 13M, and the cyan photosensitive drum 13C, will not rotate because of engagement between the first worm wheel 34 and the first worm gear 31, for example.

Also, although during reverse drive of the drive shaft 35 the first worm wheel 34 rotates in association with rotational drive of the black photosensitive drum 13K and, by its meshing engagement with the first worm wheel 34, the first worm gear 31 is driven to rotate in the opposite direction from the reverse rotation direction of the drive shaft 35, the first one-way clutch mechanism 36 that corresponds to the black photosensitive drum 13K prevents the drive force from being transmitted to the drive shaft 35. Therefore, smooth reverse drive of the drive shaft 35 can be achieved.

Accordingly, by driving the motor M in reverse so that the drive shaft 35 rotates in reverse, the black photosensitive drum 13K can be smoothly driven to rotate while the yellow photosensitive drum 13Y, the magenta photosensitive drum 13M, and the cyan photosensitive drum 13C are stopped. A high-quality monochrome image can be formed.

In this way, when a full color image is to be formed, the drive shaft 35 is driven in the forward direction so that all of the photosensitive drums 14 are driven to rotate through the first worm gears 31 and the first worm wheels 34. On the other hand, when a monochrome image is to be formed, the drive shaft 35 driven to rotate in the reverse direction so that only the black photosensitive drum 13K is driven to rotate through the second worm gear 40, the second worm wheel 41, the second gear 33, and the first gear 37. That is, all four photosensitive drums 13 for forming a full color image or only the black photosensitive drum 13K for forming a monochrome image can be selected by merely switching drive direction of the drive shaft 35. With this configuration, color images and monochrome images can be selectively formed using a simpler configuration that is less costly to produce than other configurations, for example, than a configuration that provides a separate motor for each photosensitive drum or an electromagnetic clutch along the drive transmission path for transmitting force to the photosensitive drums. Moreover, because the drive direction of the drive shaft 35 is merely switched between forward and reverse, there is no need to provide a large drive as would be the case were an electromagnetic clutch provided. Therefore, running costs can be reduced.

Because the three photosensitive drums 13Y, 13M and 13C are driven by forward drive of the drive shaft 35 and the single black photosensitive drum 13K is driven by forward and reverse drive of the drive shaft 35, when the drive shaft 35 drives in the forward direction, then all of the photosensitive drums 13 are driven. On the other hand, when the drive shaft 35 drives in the reverse direction, then only the black photosensitive drum 13K is driven to rotate. The four photosensitive drums 13K can be selectively driven in a reliable manner with a simple configuration by merely switching between forward and reverse drive of the drive shaft 35 Moreover, the black photosensitive drum 13K is is driven to rotate in the same direction as the other three photosensitive drums 13Y, 13M, and 13C during both forward and reverse drive of the drive shaft 35. Therefore, images can be formed in a smooth manner.

First one-way clutch mechanisms 36, which transmit drive force only during forward drive of the drive shaft 35, are provided along the drive transmission path between the drive shaft 35 and the yellow photosensitive drum 13Y, the magenta photosensitive drum 13M, and the cyan photosensitive drum 13C. Another of the first one-way clutch mechanisms 36 and also a second one-way clutch mechanism 39, which transmits drive force only during reverse drive of the drive shaft 35, are provided along the drive transmission path between the drive shaft 35 and black photosensitive drum 13K. With this configuration, when the drive shaft 35 is driven in the forward direction, the drive force is transmitted through the first one-way clutch mechanisms 36 to drive the yellow photosensitive drum 13Y, the magenta photosensitive drum 13M, the cyan photosensitive drum 13C, and the black photosensitive drum 13K to form a color image. Also, when the drive shaft 35 is driven to rotate in the reverse direction, then the drive force is transmitted through the second one-way clutch mechanism 39 to drive only the black photosensitive drum 13K. Drive force can be reliably and selectively transmitted to the photosensitive drums for forming color images and to the photosensitive drum for forming a monochrome image using a simple configuration for switching between driving the drive shaft 35 in the forward and reverse directions.

Further, because drive force is transmitted unit-directionally using the first one-way clutch mechanisms 36 and the second one-way clutch mechanism 39, drive force can be simply and reliably transmitted in one direction. Manufacturing costs can be reduced and selective transmission of drive force can be reliably performed.

Although not show in the drawings, the color laser printer 1 includes a central processing unit (CPU) that judges whether to drive the motor M and the drive shaft 35 forward or in reverse, that is, in order to print multi-color or monochrome images, based on image data input to the color laser printer 1.

Although not shown in the drawings, a cam mechanism is provided for moving the endless belt 22 selectively into contact with all of the photosensitive drums 13 or just the black photosensitive drum 13K depending on whether a monochrome image or a multi-color image is being formed. That is, when a monochrome image is to be formed, the can mechanism is driven by reverse drive of the drive shaft 35 to move the second roller 24 downward from a first position indicated in FIG. 1 by solid line to a second position indicated in FIG. 1 in two-dot chain line. In this condition, the endless belt 22 is in contact with only the black photosensitive drum 13K. The yellow photosensitive drum 13Y, the magenta photosensitive drum 13M, and the cyan photosensitive drum 13C are separated from the endless belt 22. On the other hand, when a multi-color image is to be formed, the cam mechanism is driven by forward drive of the drive shaft 35 to move the second roller 24 upward from the second position to the first position. In this condition, the endless belt 22 is in contact with all of the photosensitive drums 13 as indicated by solid line in FIG. 1. With this configuration, images from either all of the photosensitive drums 13 or just the black photosensitive drum 13Y can be selectively transferred onto the endless belt 22 by switching merely between driving the drive shaft 35 forward and reverse. As a result, the images formed by driving either all the photosensitive drums 13 to form a multi-color image or just the black photosensitive drum 13K to form a monochrome image can be selectively transferred onto the endless belt 22 simply and reliably.

While the invention has been described in detail with reference to specific embodiments thereof, it would be apparent to those skilled in the art that various changes and modifications may be made therein without departing from the spirit of the invention, the scope of which is defined by the attached claims.

For example, the intermediate transfer mechanism 9 need not be provided, depending on the objectives and use the color laser printer 1. That is, the embodiment described using the intermediate transfer mechanism 1 for transferring the different color images formed by the different photosensitive drums 13 one at a time onto the endless belt 22 and then, after a multi-color image is formed on the endless belt 22, transferring the multi-color image in a single action onto the sheet 3. However, the intermediate transfer mechanism 9 need not be provided. Instead, a transfer roller can be disposed in confrontation with each of the photosensitive drums, and the visible images formed at each of the photosensitive drums can be transferred directly onto a sheet 3 that passes between the photosensitive drums and the transfer rollers.

Also, the switching operation achieved by the first one-way clutch mechanisms 36 and the reverse clutch mechanism 39 is not limited to switching between multi-color and monochrome image formation. For example, the first one-way clutch mechanisms 36 and the reverse clutch mechanism 39 can be used for switching to two-color or to three-color image formation instead. Also, the first one-way clutch mechanisms 36 and the reverse clutch mechanism 39 can be used for switching between two different types of monochrome image formation, such as from black image to red image formation.

Also, in the embodiment, the second roller 24 was moved up and down by a cam mechanism driven by forward and reverse drive of the drive shaft 35. However, the endless belt 22 can be switched between the first and second contact positions using other configurations, such as a solenoid and plunger.

What is claimed is:

1. An image forming device using a plurality of image forming units, comprising:

a plurality of photosensitive bodies, each image forming unit having a photosensitive body, each photosensitive body forming an image having a different color; and a single drive unit that switches between driving at least one of the photosensitive bodies and at least a different one of the photosensitive bodies, wherein the drive unit selectively switches between forward drive and reverse drive to switch between driving the at least one and the at least a different one of the photosensitive bodies.

2. An image forming device as claimed in claim 1, wherein the at least one of the photosensitive bodies is driven to move in a direction by only one of forward drive and reverse drive of the drive unit, and the at least a different one of the photosensitive bodies is driven to move in the same direction as the at least one of the photosensitive bodies by both forward drive and reverse drive of the drive unit.

3. An image forming device as claimed in claim 2, further comprising:

a first transmission unit provided along a drive transmission path between the drive unit and the at least one of the photosensitive bodies, the first transmission unit transmitting drive of only one of forward drive and reverse drive from the drive unit to the at least one of the photosensitive bodies; and a second transmission unit provided in a drive transmission path between the drive unit and the at least a different one of the photosensitive bodies, the second drive transmission unit transmitting drive of only the other of forward drive and reverse drive from the drive unit to the at least a different one of the photosensitive bodies.

4. An image forming device as claimed in claim 3, wherein both the first transmission unit and the second transmission unit each include a one way clutch.

5. An image forming device as claimed in claim 2, further comprising a transfer member that, in association with the drive unit switching between forward drive and reverse drive, selectively switches between a first contact position in contact with both the at least one of the photosensitive bodies and the at least a different one of the photosensitive bodies and a second contact position in contact with only the at least a different one of the photosensitive bodies.

6. An image forming device as claimed in claim 1, wherein the photosensitive bodies are each supported at its outer peripheral surface to be rotatable by at least the drive unit.

7. An image forming device as claimed in claim 6, wherein each photosensitive body is provided at its outer peripheral surface with a worm wheel, the drive unit including worm gears that are meshingly engaged with the worm wheels of the photosensitive bodies to transmit drive force from the drive unit to all of the photosensitive bodies.

8. An image forming device as claimed in claim 1, wherein the at least a different one of the photosensitive bodies is a single photosensitive body for forming a monochrome image and the at least one of the photosensitive bodies is a plurality of photosensitive bodies for forming a multi-color image.

9. An image forming device as claimed in claim 1, wherein the at least a different one of the photosensitive bodies is a single photosensitive body for forming a black image and the at least one of the photosensitive bodies is a different single photosensitive body for forming a red image.

10. An image forming device as claimed in claim 1, wherein the at least a different one of the photosensitive bodies is a single black-image forming photosensitive body for forming a black image and the at least one of the photosensitive bodies includes the black-image forming photosensitive body, a cyan-image forming photosensitive body for forming a cyan image, a magenta-image forming photosensitive body for forming a magenta image, and a yellow-image forming photosensitive body for forming a yellow image, the single drive unit switching to one of the forward drive and the reverse drive to drive all of the black-image forming photosensitive body, the cyan-image forming photosensitive body, the magenta-image forming photosensitive body, and the yellow-image forming photosensitive body to form a multicolor image.

11. An image forming device, comprising:

a plurality of developing units, each developing unit being provided for a different one of a plurality of colors;

a plurality of photosensitive bodies provided in correspondence with the developing units;

a transfer unit disposed in confrontation with the photosensitive bodies;

a single drive unit that generates drive force; and a transmission mechanism that switches transmission of the drive force from the drive unit to photosensitive bodies selected in accordance with drive condition of the drive unit, wherein the drive unit switches between forward drive and reverse drive, the transmission mechanism transmitting the drive force to at least one of the photosensitive bodies when the drive unit is driving in forward drive and to at least a different one of the photosensitive bodies when the drive unit is driving in reverse drive.

12. An image forming device as claimed in claim 11, wherein the transmission mechanism drives the photosensitive bodies in the same direction using both forward drive and reverse drive from the drive unit.

13. An image forming device as claimed in claim 11, wherein the drive unit switches between forward drive and reverse drive depending on whether a monochrome image or a multicolor image is to be formed.

14. An image forming device as claimed in claim 11, wherein the transmission mechanism transmits the drive force to only a particular single one of the photosensitive bodies when a monochrome image is to be formed and to all of the photosensitive bodies including the particular single one of the photosensitive bodies when a multicolor image is to be formed.

15. An image forming device as claimed in claim 11, wherein the transmission mechanism includes:

a first transmission unit provided along a drive transmission path between the drive unit and the at least one of the photosensitive bodies, the first transmission unit transmitting drive of only one of forward drive and reverse drive from the drive unit to the at least one of the photosensitive bodies; and a second transmission unit provided in a drive transmission path between the drive unit and the at least a different one of the photosensitive bodies, the second drive transmission unit transmitting drive of only the other of forward drive and reverse drive from the drive unit to the at least a different one of the photosensitive bodies.

16. An image forming device as claimed in claim 11, wherein the transfer unit, in association with the drive unit switching between forward drive and reverse drive, selectively switches between a first contact position in contact with the at least one of the photosensitive bodies and the at least a different one of the photosensitive bodies and a second contact position in contact with only the at least a different one of the photosensitive bodies.

17. An image forming device comprising:

a plurality of developing units, each developing unit being provided for a different one of a plurality of colors;

a plurality of photosensitive bodies provided in correspondence with the developing units;

a transfer unit disposed in confrontation with the photosensitive bodies;

a single drive unit that switchingly generates forward drive force and reverse drive force; and a transmission mechanism that transmits drive force from the drive unit to the photosensitive bodies, the transmission mechanism transmitting the same direction of drive force to the photosensitive bodies regardless of whether the drive unit generates forward drive force or reverse drive force.

18. An image forming device as claimed in claim 17, wherein the drive unit switches between forward drive and reverse drive depending on whether a monochrome image or a multicolor image is to be formed.

19. An image forming device as claimed in claim 17, wherein the transmission mechanism transmits the drive force to only a particular single one of the photosensitive bodies when a monochrome image is to be formed and to all of the photosensitive bodies including the particular single one of the photosensitive bodies when a multicolor image is to be formed.

20. An image forming device as claimed in claim 17, wherein the transmission mechanism includes:

a first transmission unit provided along a drive transmission path between the drive unit and at least one of the photosensitive bodies, the first transmission unit transmitting drive of only one of forward drive and reverse drive from the drive unit to the at least one of the photosensitive bodies; and a second transmission unit provided in a drive transmission path between the drive unit and at least a different one of the photosensitive bodies, the second drive transmission unit transmitting drive of only the other of forward drive and reverse drive from the drive unit to the at least a different one of the photosensitive bodies.

21. An image forming device as claimed in claim 17, wherein the transfer unit, in association with the drive unit switching between forward drive and reverse drive, selectively switches between a first contact position in contact with the at least one of the photosensitive bodies and the at least a different one of the photosensitive bodies and a second contact position in contact with only the at least a different one of the photosensitive bodies.

* * * * *